US010280686B2

(12) United States Patent
Lin et al.

(10) Patent No.: US 10,280,686 B2
(45) Date of Patent: May 7, 2019

(54) METHOD OF PERFORMING COMBINED DRILLING, FLUSHING, AND CUTTING OPERATIONS ON COAL SEAM HAVING HIGH GAS CONTENT AND PRONE TO BURSTS TO RELIEVE PRESSURE AND INCREASE PERMEABILITY

(71) Applicant: CHINA UNIVERSITY OF MINING AND TECHNOLOGY, Xuzhou (CN)

(72) Inventors: Boquan Lin, Xuzhou (CN); Tong Liu, Xuzhou (CN); Yabin Gao, Xuzhou (CN); He Li, Xuzhou (CN); Zhanbo Huang, Xuzhou (CN); Rui Wang, Xuzhou (CN); Wei Yang, Xuzhou (CN)

(73) Assignee: CHINA UNIVERSITY OF MINING AND TECHNOLOGY, Xuzhou (CN)

( * ) Notice: Subject to any disclaimer, the term of this patent is extended or adjusted under 35 U.S.C. 154(b) by 16 days.

(21) Appl. No.: 15/548,060

(22) PCT Filed: Mar. 31, 2016

(86) PCT No.: PCT/CN2016/077971
§ 371 (c)(1),
(2) Date: Aug. 1, 2017

(87) PCT Pub. No.: WO2017/092207
PCT Pub. Date: Jun. 8, 2017

(65) Prior Publication Data

US 2017/0370156 A1 Dec. 28, 2017

(30) Foreign Application Priority Data

Nov. 30, 2015 (CN) ..... 2015 1 0866018

(51) Int. Cl.
*E21B 7/18* (2006.01)
*E21F 7/00* (2006.01)
*E21B 7/04* (2006.01)

(52) U.S. Cl.
CPC ..... *E21B 7/18* (2013.01); *E21B 7/046* (2013.01); *E21F 7/00* (2013.01)

(58) Field of Classification Search
CPC ..... E21B 7/18; E21B 7/046
(Continued)

(56) References Cited

U.S. PATENT DOCUMENTS 4,140,346 A * 2/1979 Barthel ..... E21B 43/28 175/67
5,014,788 A * 5/1991 Puri ..... E21B 43/006 166/305.1
(Continued)

FOREIGN PATENT DOCUMENTS

CN 101644166 2/2010
CN 104131832 11/2014
(Continued)

*Primary Examiner* — Taras P Bemko
(74) *Attorney, Agent, or Firm* — Treasure IP Group, LLC

(57) ABSTRACT

A method of performing coupled drilling, flushing, and slotting operations on a coal seam, which has a high gas content and prone to bursts, is described herein. The method is aimed to relieve pressure and increase permeability when drilling a through-seam borehole to pre-drain gas belts in a coal mine roadway. The pressure relief and permeation method of the present invention adjusts the water jet water inlet pressure in different stages according to the different positions of the drilling construction, and controls the water during drilling. At drilling stage, the jets are respectively subjected to low-pressure water flow drilling and medium-pressure water flow flushing. When withdraw drilling, the high-pressure water flow slotting is carried out. By doing so,
(Continued)

the pressure is relieved in a low, medium, high stepwise manner.

1 Claim, 2 Drawing Sheets

(58) Field of Classification Search
USPC ..... 175/162
See application file for complete search history.

(56) References Cited

U.S. PATENT DOCUMENTS

| | | | | |
|---|---|---|---|---|
| 6,024,171 | A | 2/2000 | Montgomery et al. | |
| 7,264,048 | B2 * | 9/2007 | Zupanick | E21B 43/006 166/245 |
| 2017/0145794 | A1 * | 5/2017 | Lin | E21B 43/24 |

FOREIGN PATENT DOCUMENTS

| | | |
|---|---|---|
| CN | 104563990 | 4/2015 |
| CN | 105422069 | 3/2016 |

* cited by examiner

METHOD OF PERFORMING COMBINED DRILLING, FLUSHING, AND CUTTING OPERATIONS ON COAL SEAM HAVING HIGH GAS CONTENT AND PRONE TO BURSTS TO RELIEVE PRESSURE AND INCREASE PERMEABILITY

CROSS REFERENCE TO RELATED APPLICATION

This application is a national stage application of a PCT application PCT/CN2016/077971, Mar. 31, 2016, entitled "METHOD OF PERFORMING COMBINED DRILLING, FLUSHING, AND CUTTING OPERATIONS ON COAL SEAM HAVING HIGH GAS CONTENT AND PRONE TO BURSTS TO RELIEVE PRESSURE AND INCREASE PERMEABILITY," which further takes priority from a Chinese application CN 20151086018.4, filed Nov. 30, 2015. The international application and Chinese priority application are incorporated herein by reference in their entireties.

BACKGROUND

Technical Field

The present invention is directed to a "drilling-flushing-slotting" coupled pressure relief and permeability increasing method for a high gas outburst coal seam, which is more particularly suitable for pressure relief and permeability increasing when gas of a roadway band of the high gas outburst coal seam is pre-extracted through crossing boreholes.

Related Art

The pre-extraction of a coal seam gas through a crossing borehole is one of main gas control measures at present; however, most of the coal seams in China have the characteristics of micro pores, high adsorption and low permeability, so that the gas is difficult to effectively extract, and measures must be taken to increase the gas permeability of the coal seam. Therefore, various borehole pressure relief and permeability increasing technologies have been researched by scholars at home and abroad for pressure relief and permeability increasing of the high gas outburst coal seam; by modifying a coal reservoir, the effective stress of the coal seam and the gas flowing resistance are reduced, so that the gas extraction effect is improved; and the technologies mainly include a loosening blasting technology, a gas injection permeability increasing technology, a hydraulic slotting technology, a hydraulic flushing technology and the like. These technologies all have good pressure relief, permeability increasing and flow increasing effects, but are restricted by various factors in the on-site large-scale application, which are summarized herein as follows:

① some technologies directly act on the original high outburst coal seam to form serious disturbances which are likely to induce dynamic phenomena such as gas outburst;

② high-energy mediums adopted by some technologies are uncontrollable, so that construction security is difficult to ensure;

③ the process is complicated, the effective influence radius is small, and the regional permeability increasing effect are non-ideal; and ④ the application condition of the single technology is limited, so that the permeability increasing requirements of coal under different conditions are difficult to meet. Therefore, there is an urgent need for researching new pressure relief and permeability increasing technologies, so that on the basis of integrating the advantages of the prior art, the limitation of single technology is broken through, the application range of the permeability increasing technology is enlarged, and the gas extraction effect of the regional coal is improved.

SUMMARY OF THE INVENTION

The present invention aims to overcome the weaknesses in the prior art and provide a "drilling-flushing-slotting" coupled pressure relief and permeability increasing method for a high gas outburst coal seam, which is simple in process, safe and reliable, can break through the limitation of a single technology, can effectively enlarge the application range of a permeability increasing technology, and can improve the gas extraction effect of the regional coal.

In order to realize the above objective, the "drilling-flushing-slotting" coupled pressure relief and permeability increasing method for the high gas outburst coal seams of the present invention adjusts the water inlet pressure of a water jet at different stages according to different positions where the borehole construction is carried out; when drilling, the water jet is controlled to respectively perform low pressure water flow drilling and medium pressure water flow flushing; when a drill bit is withdrawn, the high pressure water flow slotting is performed; and the pressure is gradually released level by level according to the low pressure water flow, the medium pressure water flow and the high pressure water flow, thereby implementing the "drilling-flushing-slotting" coupled pressure relief and permeability increasing integrated operation inside a crossing borehole. The method includes specific steps as follows:

a. arranging multiple crossing boreholes to a pre-extraction area of the coal seam from a floor rock roadway;
b. constructing multiple crossing boreholes arranged in the pre-extraction area one by one by utilizing a pressure controlled integrated drill bit, where when the pressure control integrated drill bit does not drill to the coal seam, a low-pressure water jet of 3 to 5 MPa is utilized to assist the drilling and the slagging, so that when the drilling speed is increased, a dust-fall effect is achieved;
c. increasing the pressure of the water jet to 8 to 12 MPa when the pressure control integrated drill bit drills to reach a coal seam floor and enters the coal seam, and flushing the borehole by adopting a medium pressure water jet at the coal seam, where since a front portion of the pressure control integrated drill bit is pressed in the drilling process, a side spray nozzle of the pressure control integrated drill bit is closed under the pressure, the water jet flushes the front coal only through a front spray nozzle, as the broken coal is discharged, a pressure relief hole is formed in the coal seam, and the internal energy of the coal is primarily released;
d. observing a coal output situation at a drilling opening, determining an occurrence condition of the coal seam, and stopping drilling when the borehole runs through the coal seam;
e. withdrawing the drill bit, further increasing the water pressure of the water jet in the withdrawing process, and adopting a high-pressure water jet of 15 to 25 MPa to cut the coal, where since the front portion of the pressure control integrated drill bit is not pressed, the front spray nozzle is closed, the side spray nozzle is opened, the water jet is sprayed out only from the side spray nozzle, and a lot of hydraulic cutting slots are formed in the coal seam in the withdrawing process, so that the homogeneous pressure relief of the coal is realized; and f. forming a crossing extraction borehole of a particular shape after the hydraulic slotting is completed in the coal seam, stopping conveying high-pressure water to the pressure control integrated drill bit, and withdrawing the pressure control integrated drill bit and a drill stem from the borehole while keeping rotating.

The present invention has the beneficial effects: in view of the problems of the various existing drilling pressure relief and permeability increasing measures that the gas outburst is likely to induce when the original high outburst coal seam is directly constructed, the high-energy medium is uncontrollable, the security is poor, the process is complicated, the effective influence radius is small, the regional permeability increasing effect is non-ideal, the application condition of the single technology is limited, the permeability increasing requirements of the coal under different conditions are difficult to meet, and the like, the hydraulic flushing and the hydraulic slotting are reasonably combined, and a "drilling-flushing-slotting" dedicated device is utilized to implement the coupled operation of "low pressure drilling-medium pressure flushing-high pressure slotting" in a borehole, so that the coal in the pre-extraction area is deformed and moved to form network cracks, passages are provided to the desorption flow of the gas, the single-hole pressure relief influence range is enlarged, the gas permeability of the coal seam is increased, the gas is easier to extract, and the gas extraction efficiency is improved. On the basis of adopting the crossing borehole pre-extraction measure for the coal seam gas, the technological advantages of the hydraulic flushing and the hydraulic slotting are integrated, the coupled integrated operation of the "low pressure drilling-medium pressure flushing-high pressure slotting" is implemented, and the influence range of the pressure relief borehole is enlarged; after the "drilling-flushing-slotting" coupled pressure relief, the coal in the pre-extraction area is deformed and moved to form network cracks, and passages are provided to the desorption flow of the gas, so that the gas is easier to extract; by controlling the water jet to gradually release the pressure level by level, the internal energy of the coal can be gradually released, the power for the gas outburst is eliminated, and construction security is ensured; by utilizing the method, the single-hole pressure relief influence range can be enlarged, the gas permeability of the coal seam is increased, the gas extraction efficiency is improved, the number of the pre-extraction boreholes is reduced, and the pre-extraction time is shortened; and moreover, the construction process is simple, the device is safe and reliable, and the method has good applicability to different coal seams in different occurrence states. The present invention can reduce the number of the crossing boreholes by 32.5% and can reduce the length of each crossing borehole by 42.9%; the coal roadway regional outburst eliminating effect is remarkable; the tunneling speed is obviously increased; a good pressure relief and permeability increasing effect is achieved; reliable technical support is provided for the gas extraction of the high outburst coal seam, and the adoption value is extremely high.

BRIEF DESCRIPTION OF THE DRAWINGS

FIG. 2(*b*) is a structural schematic diagram illustrating medium pressure flushing according to the present invention.

FIG. 2(*c*) is a structural schematic diagram illustrating high pressure slotting according to the present invention.

Figure 1:
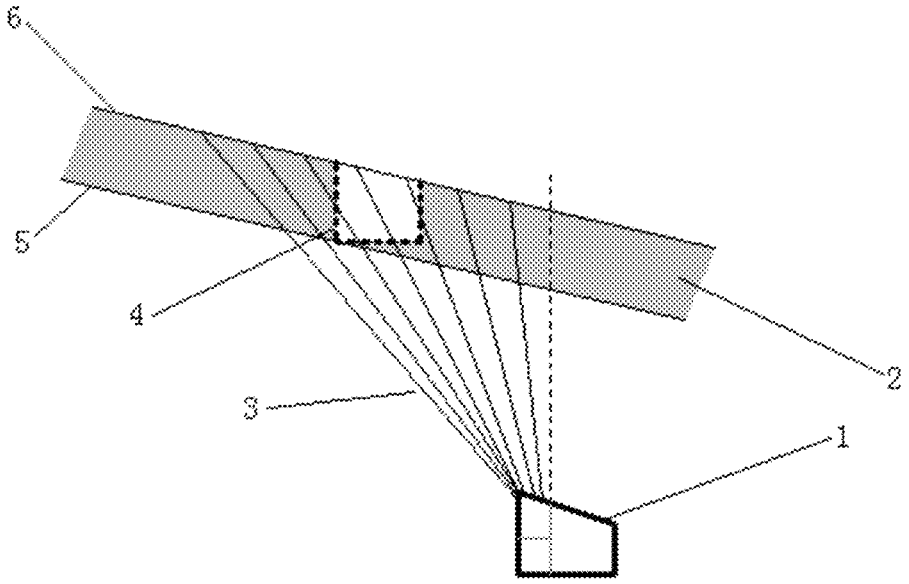
FIG. 1 is a layout schematic diagram illustrating a crossing borehole according to the present invention.

In the drawings: 1—floor rock roadway; 2—coal seam; 3—crossing borehole; 4—coal roadway; 5—coal seam floor; 6—coal seam roof; 7—pressure control integrated drill bit; 8—drill stem; 9—pressure relief hole; 10—pressure relief slot; 11—crossing extraction borehole of particular shape.

DETAILED DESCRIPTION

The present invention is further described below in combination with embodiments in the drawings:

A "drilling-flushing-slotting" coupled pressure relief and permeability increasing method for a high gas outburst coal seam of the present invention adjusts the water inlet pressure of a water jet at different stages according to different positions where the borehole construction is carried out; when drilling, the water jet is controlled to respectively perform the low pressure water flow drilling and the medium pressure water flow flushing; when a drill bit is withdrawn, high pressure water flow slotting is performed; and the pressure is gradually released level by level according to the low pressure water flow, the medium pressure water flow and the high pressure water flow, thereby implementing the "drilling-flushing-slotting" coupled pressure relief and permeability increasing integrated operation inside a crossing borehole 3. The method includes specific steps as follows:

a. arranging multiple crossing boreholes 3 to a pre-extraction area of a coal seam 2 from a floor rock roadway 1;

b. constructing multiple crossing boreholes 3 arranged in the pre-extraction area one by one by utilizing a pressure control integrated drill bit 7, where when the pressure control integrated drill bit 7 does not drill to reach the coal seam 2, a low-pressure water jet of 3 to 5 MPa is utilized to assist the drilling and the slagging, so that while the drilling speed is increased, a dust-fall effect is achieved;

c. increasing the pressure of the water jet to 8 to 12 MPa when the pressure control integrated drill bit 7 drills to reach a coal seam floor 5 and enters the coal seam 2, and flushing the borehole by utilizing a medium pressure water jet at the coal seam 2, where since a front portion of the pressure control integrated drill bit 7 is pressed in the drilling process, a side spray nozzle of the pressure control integrated drill bit 7 is closed under the pressure, the water jet flushes the front coal only through a front spray nozzle, as the broken coal is discharged, a pressure relief hole 9 is formed in the coal seam 2, and the internal energy of the coal is primarily released;

d. observing a coal output situation at a drilling opening, determining an occurrence condition of the coal seam 2, and stopping the drilling when the borehole 3 runs through the coal seam 2;

e. withdrawing the drill bit, further increasing the water pressure of the water jet in the withdrawing process, and adopting a high-pressure water jet of 15 to 25 MPa to cut the coal, where since the front portion of the pressure control integrated drill bit 7 is not pressed, the front spray nozzle is closed, the side spray nozzle is opened, the water jet is sprayed out only from the side spray nozzle, and many hydraulic cutting slots 10 are formed in the coal seam 2 in the withdrawing process, so that the homogeneous pressure relief of the coal is realized; and f. forming a crossing extraction borehole 11 of a particular shape after the hydraulic slotting is completed in the coal seam 2, stopping conveying high-pressure water to the pressure control integrated drill bit 7, and withdrawing the pressure control integrated drill bit 7 and a drill stem 8 from the borehole 3 while keeping rotating.

Embodiment 1: As Shown in FIG. 1

Figure 2A:
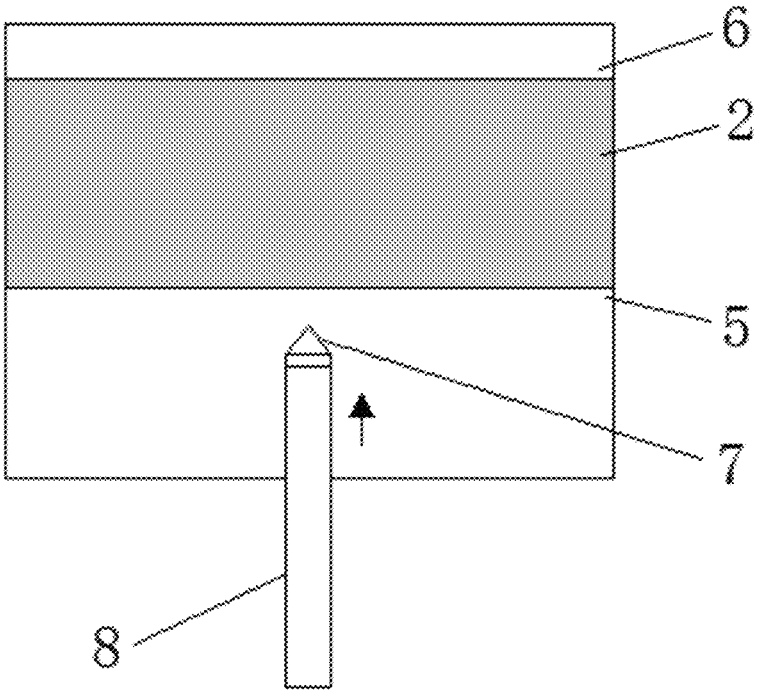
FIG. 2(*a*) is a structural schematic diagram illustrating low pressure drilling according to the present invention.
Figure 2B:
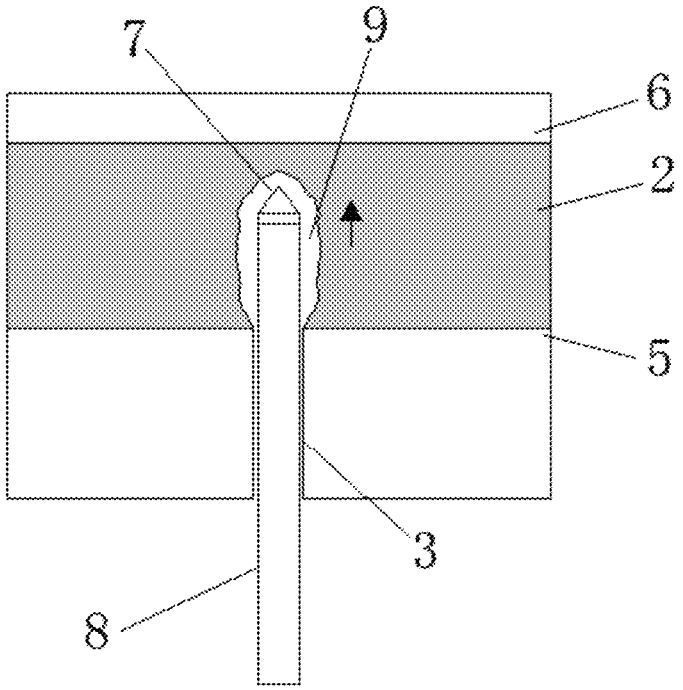
Figure 2C:
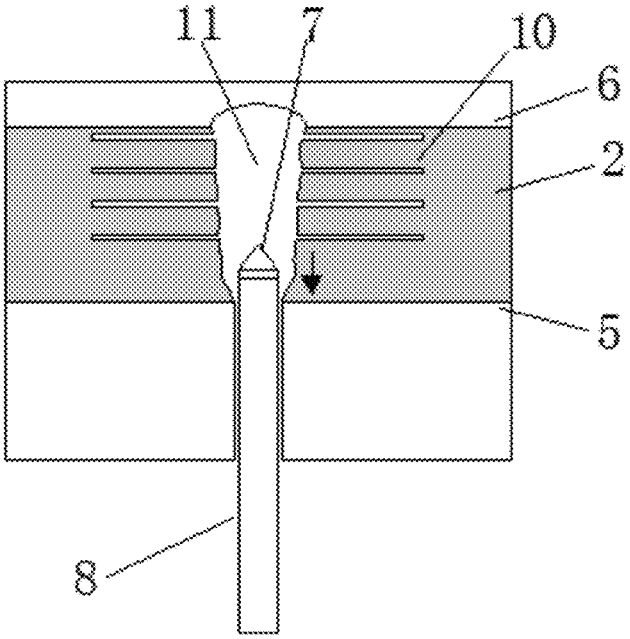

The coal seam 2 is a high gas outburst coal seam, a coal roadway 4 is high in outburst danger when in tunneling. In order to eliminate the outburst danger, the coal seam gas of a roadway band is pre-extracted, the upward crossing borehole 3 is constructed to the coal seam 2 in the floor rock roadway 1 at the lower portion of the coal seam 2 to pre-extract the gas of the coal seam 2 so as to protect the tunneling of the coal roadway 4; multiple crossing boreholes 3 are arranged to a pre-extraction area of the coal seam 2 from the floor rock roadway 1; the multiple crossing boreholes 3 arranged in the pre-extraction area are gradually constructed one by one by utilizing a pressure control integrated drill bit 7, when the pressure control integrated drill bit 7 does not drill to reach the coal seam 2, as shown in FIG. 2(*a*), a low-pressure water jet of 3 to 5 MPa is utilized to assist the drilling and the slagging, so that while the drilling speed is increased, the dust is effectively settled; when the pressure control integrated drill bit 7 enters the coal seam 2 from the coal seam floor 5, as shown in FIG. 2(*b*), the water pressure is increased to 8 to 12 MPa, the medium-pressure water jet is utilized to flush the borehole, since the front portion of the pressure control integrated drill bit 7 is pressed, a side spray nozzle of the pressure control integrated drill bit 7 is closed under the pressure, the water jet flushes the front coal only through a front spray nozzle, as the broken coal is discharged, a pressure relief hole 9 is formed in the coal seam 2, and the internal energy of the coal is primarily released, so that the peripheral coal is deformed and moved towards the pressure relief area, and the elastic energy of the coal and the internal energy of the gas are primarily released. For the coal seam 2 with relatively high stress or having soft coal, the primary pressure relief can avoid the collapse of the borehole 3 and the closing of the pressure relief slots 10, so that the long-term pressure relief effect is ensured; by observing the coal output situation at a drilling opening, the formation condition of the coal seam 2 is determined, and the drilling is stopped after the borehole 3 runs through the coal seam 2; the drill bit is withdrawn, the water pressure is further increased in the withdrawing process, a high-pressure water jet of 15 to 25 MPa is utilized to cut the coal, since the front portion of the pressure control integrated drill bit 7 is not pressed, the front spray nozzle is closed, the side spray nozzle is opened, the water jet is sprayed out from the side spray nozzle, the slots 10 are formed in the coal seam 2, as shown in FIG. 2(*c*), the peripheral coal is subjected to strong disturbance in different directions, the homogeneous pressure relief is realized through the borehole 3, the influence range of the borehole is increased, the gas permeability of the coal is improved, and the gas is easier to extract.

For the coal seam 2 having a hard sublayer or a parting, homogeneous coal output is difficult to implement through a single borehole, and the pressure relief effect is difficult to ensure; however, the pressure is further released by means of the slotting, the influence area of the borehole 3 is increased, the coal is homogeneous in pressure relief, and the extraction effect is better; and after the slotting is completed in the coal seam 2, the crossing extraction borehole 11 of a particular shape is formed, the high-pressure water is stopped being conveyed to the pressure control integrated drill bit 7, and the pressure control integrated drill bit 7 and a drill stem 8 are withdrawn from the borehole 3 while keeping rotating.

By virtue of the superposed effect of the water jet in different directions, the range of a plastic zone surrounding the borehole 3 is increased, a great number of secondary cracks are developed, expanded and penetrated, and the number of gas flowing passages is rapidly increased, so that the gas permeability of the coal is remarkably increased. Thus it can be seen that after the crossing borehole 3 adopts the "drilling-flushing-slotting" coupled pressure relief technology, the single-hole pressure relief influence range is enlarged, the gas permeability of the coal seam 2 is increased, gas extraction efficiency is improved, the number of the pre-extraction boreholes 3 is further reduced, the pre-extraction time is shortened, and the technology has good applicability to the coal seams 2 in different formation states.

What is claimed is:

1. A drilling-flushing-slotting coupled pressure relief and permeability increasing method for a high gas outburst coal seam comprising adjusting a water inlet pressure of a water flow at different stages according to different positions where a borehole construction is carried out, wherein when in drilling, the water flow is controlled to respectively perform a low pressure water flow drilling and a medium pressure water flow flushing;

when a drill bit is withdrawn, a high pressure water flow slotting is performed; and the water inlet pressure is gradually released level by level according to the low pressure water flow, the medium pressure water flow and the high pressure water flow, thereby implementing the drilling-flushing-slotting coupled pressure relief and permeability increasing integrated method inside a crossing borehole (3); and the method comprising the following steps:

a. arranging multiple crossing boreholes (3) to a pre-extraction area of a coal seam (2) from a floor rock roadway (1);

b. constructing the multiple crossing boreholes (3) arranged in the pre-extraction area one by one by utilizing a pressure control integrated drill bit (7), wherein when the pressure control integrated drill bit (7) does not drill to reach the coal seam (2), a low-pressure water flow of 3 to 5 MPa is utilized to assist the drilling and the slagging, so that while the drilling speed is increased, a dust-fall effect is achieved;

c. increasing the pressure of the water j-e flow to 8 to 12 MPa when the pressure control integrated drill bit (7) drills to reach a coal seam floor (5) and enters the coal seam (2), and flushing the borehole by utilizing a medium-pressure water flow at the coal seam (2), wherein since a front portion of the pressure control integrated drill bit (7) is pressed in the drilling process, a side spray nozzle of the pressure control integrated drill bit (7) is closed under the pressure, the water flow flushes the front coal only through a front spray nozzle, as the broken coal is discharged, a pressure relief hole (9) is formed in the coal seam (2), and the internal energy of the coal is primarily released;

d. observing a coal output situation at a drilling opening, determining an occurrence condition of the coal seam (2), and stopping the drilling when the borehole (3) runs through the coal seam (2);

e. withdrawing the drill bit, further increasing the water pressure of the water flow in the withdrawing process, and adopting a high-pressure water flow of 15 to 25 MPa to cut the coal, wherein since the front portion of the pressure control integrated drill bit (7) is not pressed, the front spray nozzle is closed, the side spray nozzle is opened, the water flow is sprayed out only from the side spray nozzle, and a plurality of hydraulic cutting slots (10) are formed in the coal seam (2) in the withdrawing process, so that the homogeneous pressure relief of the coal is realized; and f. forming a crossing extraction borehole (11) of a particular shape after the hydraulic slotting is completed in the coal seam (2), stopping conveying high-pressure water to the pressure control integrated drill bit (7), and withdrawing the pressure control integrated drill bit (7) and a drill stem (8) from the borehole (3) while maintaining rotation.

* * * * *